US009469989B2

(12) United States Patent
LaSorsa

(10) Patent No.: US 9,469,989 B2
(45) Date of Patent: Oct. 18, 2016

(54) DROP CEILING SUPPORT RING AND METHOD OF USE

(71) Applicant: Vincent S. LaSorsa, Cranston, RI (US)

(72) Inventor: Vincent S. LaSorsa, Cranston, RI (US)

( * ) Notice: Subject to any disclaimer, the term of this patent is extended or adjusted under 35 U.S.C. 154(b) by 0 days.

(21) Appl. No.: 14/840,715

(22) Filed: Aug. 31, 2015

(65) Prior Publication Data

US 2016/0069077 A1 Mar. 10, 2016

Related U.S. Application Data

(60) Provisional application No. 62/047,265, filed on Sep. 8, 2014.

(51) Int. Cl.
*E04B 9/30* (2006.01)
*E04B 9/18* (2006.01)
*E04B 9/24* (2006.01)

(52) U.S. Cl.
CPC . *E04B 9/30* (2013.01); *E04B 9/18* (2013.01); *E04B 9/244* (2013.01)

(58) Field of Classification Search
CPC ..... E04B 9/30; E04B 9/061; E04B 9/22; E04B 9/225; E04B 9/24; E04B 1/18; E04B 1/185; E04B 9/244; E04F 19/02
USPC ..... 52/281, 283, 282.3, 273, 506.06, 52/506.07, 506.08, 745.05; 248/200.1, 248/205.3, 220.1, 309.1
See application file for complete search history.

(56) References Cited

U.S. PATENT DOCUMENTS 1,399,748 A * 12/1921 Cheney ..... F16L 5/00 126/317
3,003,646 A 10/1961 Wolf
3,159,251 A * 12/1964 Becker ..... E04B 9/30 428/192
4,182,227 A * 1/1980 Roy ..... F24F 13/062 454/302
4,188,656 A * 2/1980 Howard ..... F21V 21/04 362/365
4,271,751 A * 6/1981 Timmons ..... F24F 13/06 248/223.41
4,335,647 A * 6/1982 Timmons ..... F24F 13/06 138/106
4,574,548 A * 3/1986 Tupman ..... E04B 9/00 52/255
5,481,845 A * 1/1996 Koenig, Jr. ..... E04B 9/30 52/287.1
5,869,159 A 2/1999 Padilla
5,941,033 A * 8/1999 Adams ..... E06B 1/30 52/211
6,477,818 B1 * 11/2002 Jensen ..... E04F 19/0436 52/287.1
2002/0096242 A1 * 7/2002 Wasitis ..... E04D 13/1407 156/71
2008/0264883 A1 10/2008 Stafford et al.

* cited by examiner

*Primary Examiner* — Joshua J Michener
*Assistant Examiner* — Theodore Adamos
(74) *Attorney, Agent, or Firm* — Sand & Sebolt

(57) ABSTRACT

An apparatus and method may include a drop ceiling tile support ring assembly which may be mounted on a lally column or pole for supporting a drop ceiling tile.

16 Claims, 5 Drawing Sheets

DROP CEILING SUPPORT RING AND METHOD OF USE

CROSS REFERENCE TO RELATED APPLICATIONS

This application is a non-provisional application of U.S. Provisional Patent Application Ser. No. 62/047,265, filed Sep. 8, 2014, the disclosure of which is incorporated herein by reference.

BACKGROUND

1. Technical Field

The technical field relates generally to drop ceiling supports. particular, the technical field relates to a drop ceiling support which may be used to support a drop ceiling tile around a lally column or vertical pole.

2. Background Information

It is well known that drop ceilings typically include a suspended ceiling grid which is used to support multiple ceiling tiles. In basements or other areas, lally columns are used to support overhead beams and thus may present an obstacle around which the drop ceiling needs to be formed. In order to accommodate the lally column or pole, a ceiling tile may be formed with a hole therein to receive therethrough the pole. In order to do this, a given ceiling tile is typically cut into two pieces such as along a straight line such that the hole to receive the pole is formed of two generally semi-circular portions respectively formed in the two pieces of the cut tile. While the ceiling grid supports the outer perimeter of the ceiling tile which is formed of the two pieces, nonetheless there is no support for the ceiling tile in the area of the hole cut therein which receives the pole. Moreover, the hole in the ceiling tile may leave an undesired appearance. Thus, there is a need in the art for a ceiling tile support to address these concerns.

SUMMARY

In one aspect, an apparatus may comprise a ring assembly configured to be secured to a pole and support a drop ceiling tile.

In another aspect, a combination may comprise a drop ceiling tile having top and bottom surfaces and defining a hole extending from the top surface to the bottom surface; a pole extending through the hole; and a ring assembly which is adjacent the hole, which is secured to and essentially circumscribes the pole, and which supports the ceiling tile.

In another aspect, a method may comprise the steps of providing a drop ceiling tile having top and bottom surfaces and defining a hole extending from the top surface to the bottom surface; and securing a ring assembly to a pole which extends through the hole to form a ceiling tile support which supports the drop ceiling tile.

BRIEF DESCRIPTION OF THE SEVERAL VIEWS OF THE DRAWINGS

One or more sample embodiments may be set forth in the following description, shown in the drawings and particularly and distinctly pointed out and set forth in the appended claims.

Similar numbers refer to similar parts throughout the drawings.

DETAILED DESCRIPTION

Figure 1:
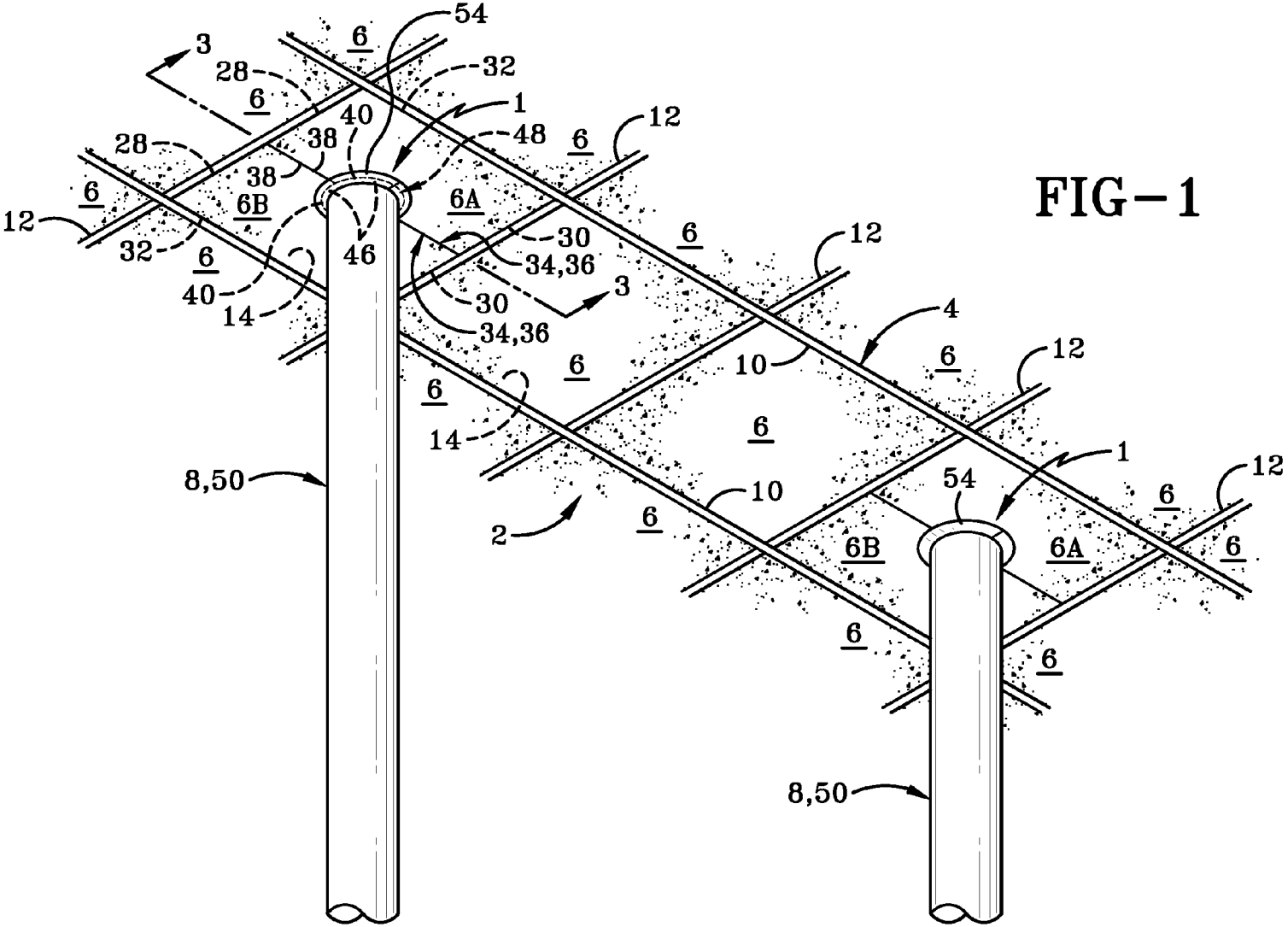
FIG. 1 is a bottom perspective view of a portion of a drop ceiling showing the upper portions of a pair of lally columns or poles and a sample pair of support ring assemblies.

A sample drop ceiling support ring assembly 1 is shown in FIGS. 1 and 2. FIG. 1 shows drop ceiling tile support ring assembly 1 in use with a drop ceiling 2 which includes a suspended ceiling grid 4 and a plurality of ceiling tiles 6 which are seated on and supported by grid 4. FIG. 1 shows a pair of lally columns or vertical poles 8 which extend upwardly and pass through drop ceiling 2. More particularly, each pole 8 passes through one of the ceiling tiles which may be formed as two ceiling tiles or two ceiling tile pieces or sections 6A and 6B. The standard full ceiling tiles 6 are shown having a square configuration as viewed from below, although they are also commonly rectangular. Each of ceiling tile pieces 6A and 6B is shown as being generally rectangular such that when pieces 6A and 6B are together, they essentially form a full ceiling tile having an outer perimeter which is substantially the same as that of each of the full ceiling tiles 6.

Figure 3:
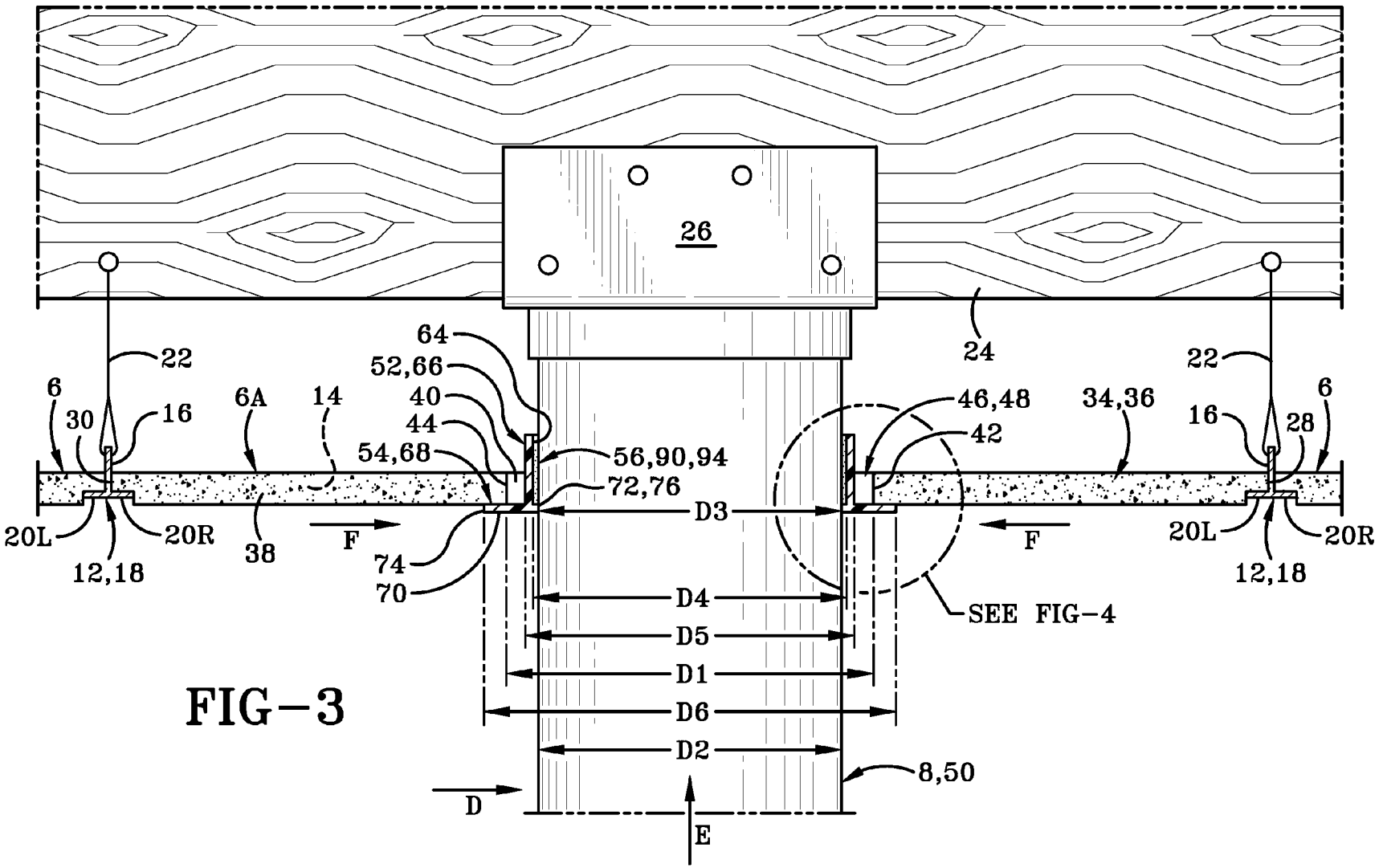
FIG. 3 is a sectional view taken on line 3-3 of FIG. 1 showing an upper end of one of the lally columns, a portion of the drop ceiling and one of the support ring assemblies.

Grid 4 includes a plurality of horizontal elongated main runners 10 which are parallel to one another, and a plurality of horizontal elongated cross runners 12 which are parallel to one another and perpendicular to runners 10. Runners 12 intersect runners 10 such that each adjacent pair of cross runners and each adjacent pair of main runners defines a tile receiving space 14 therebetween for receiving therein one of tiles 6 or a pair of tile pieces 6A and 6B. Runners 10 and 12 thus intersect one another to form squares or rectangles. Each of the full ceiling tiles 6 is received within a given one of spaces 14 such that one set of the opposed edges of tile 6 is seated on a pair of adjacent runners 10 respectively and the other set of opposed edges of tiles 6 is seated on an adjacent pair of runners 12. Each of runners 10 and 12 typically has an inverted T-shape as viewed parallel to the length of the given runner. This is shown in FIG. 3 by the inverted T-shaped cross sectional view of runners 12. Each runner 12 includes a vertical leg 16 and a horizontal segment 18 which is rigidly secured to the bottom of leg 16 and extends outwardly to the left and right therefrom to form a left leg 20L and a right leg 20R. Each of left and right legs serves as a shelf or seat on which a given straight edge of a given tile 6 or 6A or 6B is seated. Grid 4 is typically suspended from or hung from a plurality of wires 22 which extend downwardly from an overhead structure, such as from a horizontal beam 24 which may be seated atop and supported by pole 8, which may include a suitable bracket 26 on which beam 24 is seated and supported. Each wire 22 has an upper end which is secured to a support of some sort, which may include beam 24. Each wire 22 has a lower end which is secured to a given one of runners 10 and 12. Each runner 10 and each runner 12 may be supported by a plurality of wires 22 which are spaced along the length thereof.

Each of ceiling tile pieces 6A and 6B has first and second straight parallel end edges 28 and 30, a straight outer side edge 32 which extends from end edge 28 and edge 30 to form corners therewith, and an inner side edge 34 which extends from end edge 28 to end edge 30 to form corners therewith. Inner side edge 34 includes a first straight segment 36, a second straight segment 38, and a curved or semi-circular segment 40 which extends between and is connected to first and second straight segments 36 and 38. Thus, first straight segment 36 extends from end edge 20 at one corner of the tile piece to a first end of segment 40, while second straight segment 38 extends from end edge 30 at another corner of the tile piece to an opposed second end 44 of segment 40. It should be understood that the curved or semi-circular segment 40 may be a fairly rough cut shape and is thus generally curved or semi-circular. Each semi-circular segment 40 thus defines a semi-circular space 46 so that when tile pieces 6A and 6B are seated on the corresponding runners 10 and 12 of grid 4 with the respective semi-circular segments 40 of pieces 6A and 6B facing one another and with the straight edges 36 and 38 of the respective tile pieces 6A and 6B closely adjacent or abutting one another, spaces 46 together form a generally circular hole 48 from the bottom of the tile formed of pieces 6A and 6B to the top thereof. Edges 40 together thus define a diameter D1 of hole 48. Hole 48 is thus spaced from each of the adjacent pairs of runners 10 and 12 which form the space 14 in which tile pieces 6A and 6B are received.

Pole 8 has an outer surface or perimeter 50 which extends from adjacent top end 26 to adjacent a bottom end of the pole which is not shown in the figures. The bottom end of pole 8 is typically adjacent a floor and may be embedded in the floor such as a concrete floor. The outer surface 50 is typically cylindrical, whereby outer surface 50 defines an outer diameter D2 of hole 8. Diameter D2 is somewhat less than the inner diameter D1 of hole 48 such that an upper portion of pole 8 is received in and extends through hole 48. Pole 8 thus extends upwardly above hole 48 and downwardly below hole 48.

Ring assembly 1 may include a circular annular ring 51 which may have a circular annular upper wall 52 and a circular annular lower wall 54, a strip of double-sided tape 56 which may have a circular annular configuration and a peel strip 58 which may also have a circular annular configuration. The inner perimeter of ring 51 may define a circular space or passage 53 having a top entrance opening 55 and a bottom entrance opening 57 whereby space or passage 53 may be a through opening or passage extending from the top to the bottom of the ring. Unless specified or otherwise understood from context, the various references to circular herein may be understood to mean circular or essentially circular as viewed from above or below.

Figure 2A:
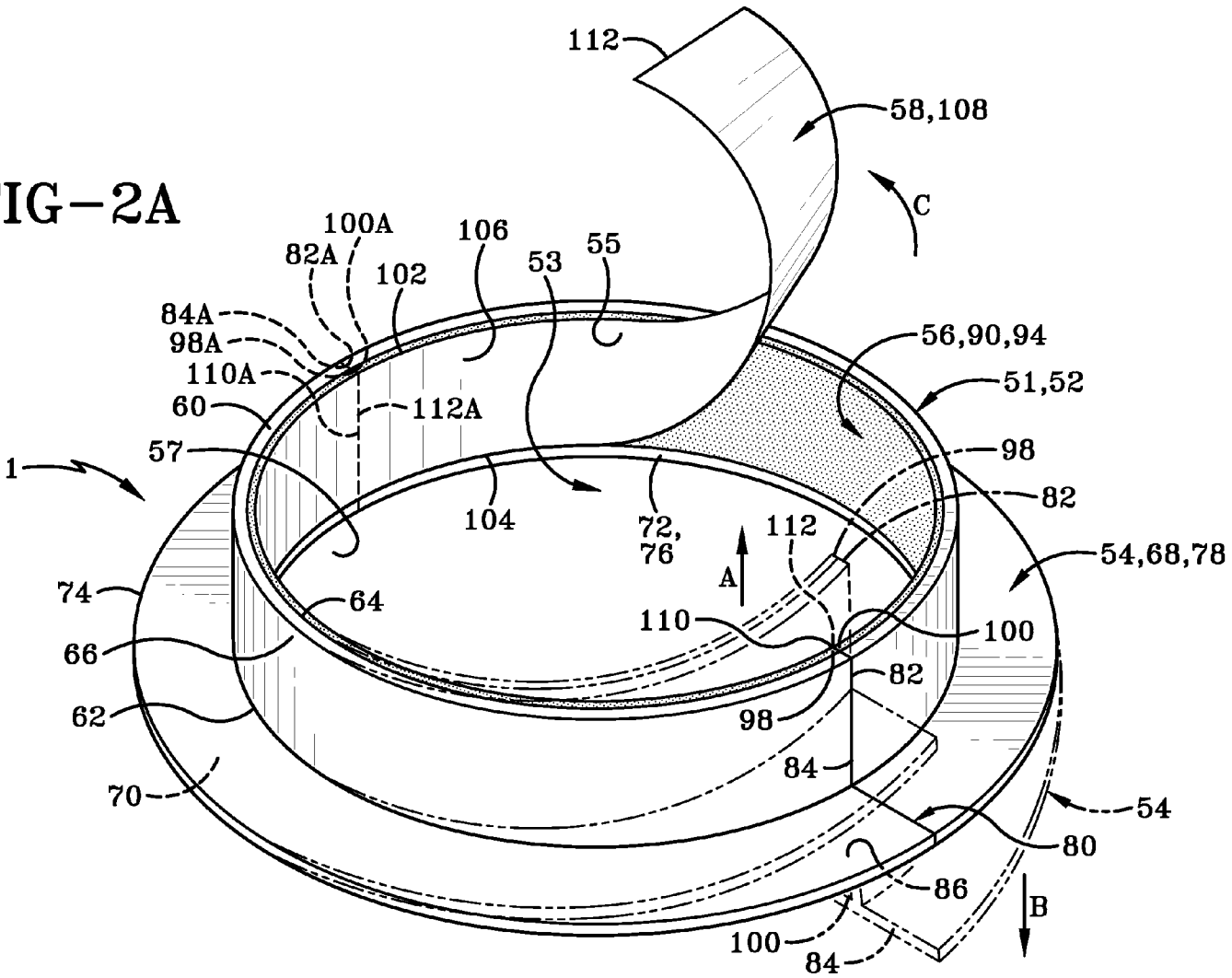
FIG. 2A is a perspective view of a drop ceiling tile support assembly which may have a one-piece or two-piece support ring, with dashed lines showing operational movement of the one-piece support ring.

Ring 51 is shown formed as one piece or two ring pieces or segments and may be formed of three or more pieces or segments although simplicity and ease of manipulation during installation generally tend to make one or two pieces more desirable. FIG. 2A illustrates both a single or one-piece ring 51 and a two-piece ring 51. Separation between the two pieces or segments of a two-piece ring embodiment is partially represented by use of a dashed line generally along the left upper portion of the ring assembly in FIG. 2A, and a two-piece ring embodiment is also shown in an exploded view in FIG. 2B in which the two ring pieces or segments are separated and spaced from one another.

An embodiment of a one-piece ring is now described with primary reference to FIG. 2A. It will be understood that the one-piece and two-piece embodiments may have similar components or structures which are evident from the Figures even if not explicitly described hereafter. Ring 51 may be formed as a single unitary piece of resilient material which essentially returns to its original home position (solid lines in FIG. 2A) after being flexed out of its original home position. Ring 51 may be formed of a plastic or other suitable material which has sufficient rigidity to serve as a support for ceiling tile pieces 6A and 6B when ring assembly 1 is secured to pole 8, while also having sufficient flexibility to allow the mounting of assembly 1 on pole 8 as described further below. Ring 51 including upper and lower walls 52 and 54 may be formed as a single molded piece of plastic. Upper wall 52 may be essentially vertical as viewed in cross section while lower wall 54 may be essentially horizontal as viewed in cross section although there may be variations. Upper and lower walls 52 and 54 may be perpendicular to one another.

Upper wall 52 may have an upwardly facing annular circular top or top edge 60, an annular circular bottom or bottom edge 62 and annular circular inner and outer perimeters 64 and 66 which extend from top 60 to bottom 62. Inner perimeter 64 faces radially inwardly toward itself and space 53 and outer surface 50/pole 8 when ring assembly 1 secured to pole 8. Outer perimeter 66 faces radially outwardly away from perimeter or surface 64 and space 53 and outer surface 50/pole 8 when ring assembly 1 is secured to pole 8. Perimeters or surfaces 64 and 66 may be essentially vertical as viewed in cross section and thus may be cylindrical or circular as viewed from above or below.

Lower wall 54 may have annular circular top and bottom surfaces 68 and 70 which respectively face upwardly and downwardly and may be essentially horizontal. Wall 54 may also have circular inner and outer perimeters 72 and 74 which may extend from top surface 68 to bottom surface 70 and which may be generally vertical. Annular wall inner and outer perimeters 72 and 74 may be relatively short or narrow and thus may be circular annular edges. Upper wall 62 may be secured to and extend upwardly from lower wall 54. It may also be that wall 54 is rigidly secured to bottom 62 of upper wall 52 and extends radially inwardly and outwardly therefrom. More particularly, wall 54 may include a circular annular inner wall segment or leg 76 and a circular annular outer wall segment or leg 78. Inner leg 76 may extend radially inwardly from bottom 62 of wall 52 beyond upper wall inner perimeter 64 to lower wall inner perimeter or inner wall segment inner perimeter 72. Outer leg 78 may extend radially outwardly from bottom 62 of wall 52 to outer wall segment outer perimeter 74. Inner and outer perimeters 72 and 74 respectively face radially inwardly and radially outwardly. Inner and outer perimeters 64 and 66 and inner and outer perimeters 72 and 74 may define circles which are concentric. Wall 52 and outer leg 78 together may form an L-shaped configuration in cross section. Likewise, wall 52 and inner leg 76 form an L-shape configuration in cross section although leg 76 may extend radially inwardly only a short distance. Outer leg 78 may be substantially horizontally longer than inner leg 76, for instance, at least 2, 3, 4, 5, 6, 7, 8, 9 or 10 times longer.

Ring 51 including upper and lower walls 52 and 54 may be circumferentially continuous except for a slit or cut 80 defined between first and second circumferential ends 82 and 84 which are closely adjacent or in contact with one another in the resting or home position of ring 51 shown in FIG. 2A in solid lines. Ends 82 and 84 in the home position may face one another and be mirror images of one another. Ends 82 and 84 may respectively have the same configuration as the cross section of ring 51 whereby the shape of ends 82 and 84 may be respectively the same as the cross sections shown respectively to the right and left of pole 8 in FIG. 3.

Circumferential ends 82 and 84 may be movable relative to one another via flexing ring 51 due to the flexible nature of the resilient material of which ring 51 is formed. For example, ends 82 and 84 may respectively be moved upwardly and downwardly relative to one another as shown at arrows A and B in FIG. 2A to a displaced position shown in dot dash lines in FIG. 2A such that ends 82 and 84 define therebetween a gap or side entrance opening 86 of space or passage 53. Although FIG. 2A only shows that ends 82 and 84 have moved a relatively short distance away from one another, it will be understood that ends 82 and 84 may be moved away from one another a fairly substantial distance such that gap or entrance opening 86 is at least as great as outer diameter D2 of pole 8. In addition to the respective upward and downward movement of ends 82 and 84 relative to one another, they may likewise be pulled or moved respectively to the left and right away from one another to facilitate forming the gap 86.

Tape 56 may include a circular annular foam body or strip 88 with adhesive for adhesively securing assembly 1 including ring 51 and tape 56 to pole 8. The adhesive may include an inner adhesive layer 90 secured to the inner perimeter of strip 88 and an outer adhesive layer 92 secured to the outer perimeter of strip 88. Layers 90 and 92 may thus be circular annular layers. Layers 90 and 92 may respectively define circular annular inner and outer adhesive perimeters or surfaces 94 and 96 of tape 56. Tape 56 may have first and second circumferential ends 98 and 100 which are analogous to and respectively aligned with or adjacent ends 84 and 82. Ends 98 and 100 may face one another and may be closely adjacent or in contact with one another in the home position of ring assembly 1. Tape 56 may be adhesively secured to wall 52 of ring 51 by adhesive layer 92 via an adhesive engagement along a portion or the entire outer perimeter or surface 96 and a portion or the entire inner perimeter or surface 64. Thus, there may be partial or continuous adhesive attachment along the entire perimeters 96 and 64, or adhesive tape may be secured in pieces along the inner perimeter 64. Tape 56 thus extends radially inwardly from inner surface 64 to inner perimeter 94 of adhesive layer 90.

Peel strip 58 may have top and bottom edges 102 and 104 and inner and outer perimeters or surfaces 106 and 108 which may extend from top edge 102 to bottom edge 104. Each of edges 102 and 104 and the inner and outer perimeters 106 and 108 may have circular annular configurations. Strip 58 may be connected to and peelably removable from adhesive layer 90 along a peelably removable connection between outer perimeter 108 and inner perimeter 94 of adhesive layer 90. As with ring 51 and tape 56, peel strip 58 may have first and second circumferential ends 110 and 112. Peel strip 58 is shown in solid lines as having been partially peeled away (arrow C in FIG. 2) from adhesive layer 90, such that circumferential end 112 is shown in solid lines separated from adhesive layer 90. FIG. 2 also shows the position of end 112 with a dashed lead line when peel strip 58 is in its home position or secured position prior to being peeled away from inner adhesive layer 90. Thus, circumferential ends 110 and 112 may be aligned with or adjacent circumferential ends 98 and 100 and ends 84 and 82 in the home position of ring assembly 1.

Figure 2B:
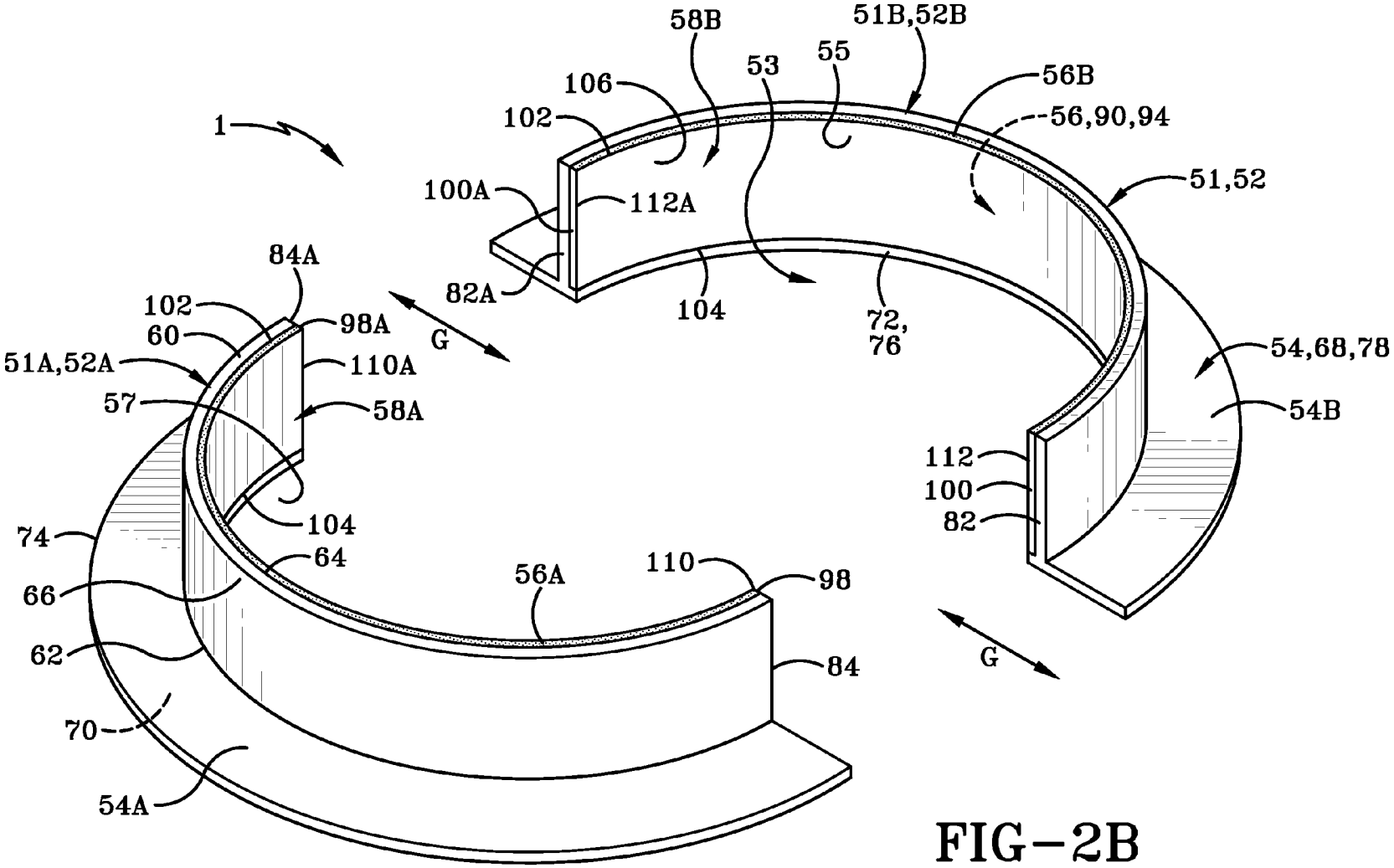
FIG. 2B is an exploded perspective view of the ring assembly with a two-piece support ring showing the two pieces separated and spaced from one another.

An embodiment of a two-piece ring is now described with primary reference to FIG. 2B. Ring 51 may be formed as two ring portions or ring pieces or ring segments 51A and 51B, which may be formed of metal or plastic or another suitable material which has sufficient rigidity to serve as a support for ceiling tile pieces 6A and 6B when ring assembly 1 is secured to pole 8. Similarly, adhesive strip or tape 56 may be formed as two tape pieces or segments 56A and 56B, and peel strip 58 may be formed as two peel strip pieces or segments 58A and 58B. Ring segments 51A and 51B may be essentially identical or essentially mirror images of one another. Likewise, tape segments 56A and 56B may be essentially identical or essentially mirror images of one another, and peel strip segments 58A and 58B may be essentially identical or essentially mirror images of one another.

Each of ring segments 51A and 51B may be essentially semicircular as viewed from above or below so that when they are in a mounting or mounted position (FIGS. 1, 2A, 3), they may together form an essentially circular ring 51. Ring segments 51A and 51B may respectively include first and second upper wall segments 52A and 52B. Likewise, ring segments 51A and 51B may respectively include first and second lower wall segments 54A and 54B. Each of upper wall segments 52A and 52B and lower wall segments 54A and 54B may be essentially semicircular as viewed from above or below.

Thus, ring 51 may include upper and lower walls 52 and 54 as described previously except that upper wall 52 may be formed as two upper wall segments, such as first and second upper wall segments 52A and 52B, and lower wall 54 may be formed as two lower wall segments, such as first and second lower wall segments 54A and 54B. Ring segment 51A may have first and second circumferential ends 84 and 84A which may lie along a common plane and may be mirror images of one another. Ends 84 and 84A may respectively have the same configuration as the cross section of ring 51 whereby the shape of ends 84 and 84A may be respectively the same as the cross sections shown respectively to the left and right of pole 8 in FIG. 3. Similarly, ring segment 51B may have first and second circumferential ends 82 and 82A which may lie along a common plane and may be mirror images of one another. Ends 82 and 82A may respectively have the same configuration as the cross section of ring 51 whereby the shape of ends 82 and 82A may be respectively the same as the cross sections shown respectively to the right and left of pole 8 in FIG. 3.

Where top and bottom edges 60 and 62 and inner and outer perimeters 64 and 66 are essentially circular, top edge 60 may be formed of respective essentially semicircular top edges or edge segments of upper wall segments 52A and 52B, bottom edge 62 may be formed of respective essentially semicircular bottom edges or edge segments of upper wall segments 52A and 52B, inner perimeter 64 may be formed of respective essentially semicircular inner surface or perimeter segments of upper wall segments 52A and 52B, and outer perimeter 66 may be formed of respective essentially semicircular outer surface or perimeter segments of upper wall segments 52A and 52B. Similarly, where top and bottom surfaces 68 and 70 and inner and outer perimeters 72 and 74 are essentially circular, top surface 68 may be formed of respective essentially semicircular top surfaces or surface segments of lower wall segments 54A and 54B, bottom surface 70 may be formed of respective essentially semicircular bottom surfaces or surface segments of lower wall segments 54A and 54B, inner perimeter 72 may be formed of respective essentially semicircular inner surface or perimeter segments of lower wall segments 54A and 54B, and outer perimeter 74 may be formed of respective essentially semicircular outer surface or perimeter segments of upper wall segments 52A and 52B.

Ring segment 51A including upper and lower wall segments 52A and 54A may be circumferentially continuous from end 84 to end 84A. Likewise, ring segment 51B including upper and lower wall segments 52B and 54B may be circumferentially continuous from end 82 to end 82A. When ring assembly 1 in the two-piece ring embodiment is in the mounting position or mounted position, such as when mounted on pole 8, end 82 and end 84 may face one another and may be closely adjacent or in contact with one another, and end 82A and end 84A may face one another and may be closely adjacent or in contact with one another, as shown in FIG. 2A. Ends 82 and 84A may be essentially identical and essentially mirror images of ends 82A and 84, respectively. Ends 82A and 84 may be essentially identical.

Inasmuch as ring segments 51A and 51B are distinct and separate pieces, they may be movable relative to one another in any direction, such as toward and away from one another, up and down relative to one another and so forth, whereby any part or surface of the ring segments may likewise be movable relative to one another. When tape segments 56A and 56B are secured to ring segments 51A and 51B, the ring assembly segments each comprising one of the ring segments and one of the tape segments may likewise be movable relative to one another.

Each of the ring segments 51A and 51B may be formed of a resilient flexible material which allows the ring segment to flex. Thus, ring segment 51A may be flexed so that ends 84 and 84A are movable relative to one another, as illustrated by Arrows G in FIG. 2B, so that a force or forces applied to one of the ring segments may cause one end to move relative to the other via flexing of the ring segment and when the force or forces are removed, the ends return to their original or home positions (shown in FIG. 2B) via flexing movement of the ring segment due to the nature of the resilient material. Ring segment 51B may likewise be flexible so that ends 82 and 82A are likewise movable. Thus, a user may manually grasp a ring segment adjacent ends 84 and 84A or ends 82 and 82A to respectively move or flex ends 84 and 84A or ends 82 and 82A apart from one another (as illustrated by Arrows G in FIG. 2B) to facilitate positioning the ring segment adjacent pole 8 and move or flex ends 84 and 84A or ends 82 and 82A back toward one another and toward pole outer surface 50 to better control application of the adhesive inner surface on pole outer surface 50 to adhesively secure the ring segment to pole 8 at the desired securing or mounting position.

Each of tape segments 56A and 56B and the foam bodies or strips 88 thereof may be essentially semicircular as viewed from above or below so that in the home position/mounting or mounted position, segments 56A and 56B may together form an essentially circular tape 56. Where inner and outer adhesive layers 90 and 92, inner and outer perimeters 94 and 96, and the top and bottom edges of tape 56 are essentially circular, inner layer 90 may be formed of respective essentially semicircular inner adhesive layer segments of tape segments 56A and 56B, outer layer 92 may be formed of respective essentially semicircular outer adhesive layer segments of tape segments 56A and 56B, inner perimeter 94 may be formed of respective essentially semicircular inner surface or perimeter segments of tape segments 56A and 56B, outer perimeter 96 may be formed of respective essentially semicircular outer surface or perimeter segments of tape segments 56A and 56B, the tape top edge may be formed of respective essentially semicircular tape segment top edges or edge segments of tape segments 56A and 56B, and the tape bottom edge may be formed of respective essentially semicircular tape segment bottom edges or edge segments of tape segments 56A and 56B.

Tape segment 56A may have first and second circumferential ends 98 and 98A which are respectively analogous to and aligned with or adjacent ends 84 and 84A. Likewise, tape segment 56B may have first and second circumferential ends 100 and 100A which are analogous to and aligned with or adjacent ends 82 and 82A. Tape segment 56A may be circumferentially continuous from end 98 to end 98A. Likewise, tape segment 56B may be circumferentially continuous from end 100 to end 100A. When ring assembly 1 in the two-piece ring embodiment is in the mounting position or mounted position, such as when mounted on pole 8, end 98 and end 100 may face one another and may be closely adjacent or in contact with one another, and end 98A and end 100A may face one another and may be closely adjacent or in contact with one another, as shown in FIG. 2A.

Tape segment 56A may be adhesively secured to upper wall segment 52A of ring segment 51A by adhesive layer 92 via an adhesive engagement along a portion or the entire semicircular outer perimeter or surface 96 of tape segment 56A and a portion or the entire semicircular inner perimeter or surface 64 of upper wall segment 52A. Thus, there may be partial or continuous adhesive attachment along the entire semicircular perimeters 96 of segment 56A and 64 of segment 52A, or adhesive tape may be secured in pieces along the inner perimeter 64 of segment 52A. Similarly, tape segment 56B may be adhesively secured to upper wall segment 52B of ring segment 51B by adhesive layer 92 via an adhesive engagement along a portion or the entire semicircular outer perimeter or surface 96 of tape segment 56B and a portion or the entire semicircular inner perimeter or surface 64 of upper wall segment 52B. Thus, there may be partial or continuous adhesive attachment along the entire semicircular perimeters 96 of segment 56B and 64 of segment 52B, or adhesive tape may be secured in pieces along the inner perimeter 64 of segment 52B.

Tape segments 56A and 56B may be flexible. Thus, when tape segments 56A and 56B are secured respectively to ring segments 51A and 51B, each of tape segments 56A and 56B may be flexibly movable along with the flexing of the respective ring segment such that ends 98 and 98A or 100 and 100A are movable away from and toward one another as the given ring segment flexes to move its respective ends 84 and 84A or 82 and 82A away from and toward one another.

Each of peel strip pieces or segments 58A and 58B may be essentially semicircular as viewed from above or below so that in the home position/mounting or mounted position, segments 58A and 58B may together form an essentially circular peel strip 58. Where top and bottom edges 102 and 104 and inner and outer perimeters or surfaces 106 and 108 of peel strip 58 are essentially circular, the peel strip top edge 102 may be formed of respective essentially semicircular peel strip segment top edges or edge segments of peel strip segments 58A and 58B, the peel strip bottom edge 104 may be formed of respective essentially semicircular peel strip segment bottom edges or edge segments of peel strip segments 58A and 58B, inner perimeter 106 may be formed of respective essentially semicircular inner surface or perimeter segments of peel strip segments 58A and 58B, and outer perimeter 108 may be formed of respective essentially semicircular outer surface or perimeter segments of peel strip segments 58A and 58B.

Peel strip segment 58A may have first and second circumferential ends 110 and 110A which are respectively analogous to and aligned with or adjacent ends 84 and 84A and respectively analogous to and aligned with or adjacent ends 98 and 98A. Likewise, peel strip segment 58B may have first and second circumferential ends 112 and 112A which are respectively analogous to and aligned with or adjacent ends 82 and 82A and respectively analogous to and aligned with or adjacent ends 100 and 100A. Peel strip segment 58A may be circumferentially continuous from end 110 to end 110A. Likewise, peel strip segment 58B may be circumferentially continuous from end 110 to end 110A. When ring assembly 1 in the two-piece ring embodiment is in the mounting position or mounted position, end 110 and end 112 may face one another and may be closely adjacent or in contact with one another, and end 110A and end 112A may face one another and may be closely adjacent or in contact with one another, as shown in FIG. 2A, although when ring assembly 1 is actually mounted on pole 8, strip segments 58A and 58B would be removed respectively from tape segments 56A and 56B such that the relative positions noted in this sentence would not occur.

Tape segment 56A may be adhesively secured to peel strip segment 58A by adhesive layer 90 via an adhesive engagement along a portion or the entire semicircular inner perimeter or surface 94 of tape segment 56A and a portion or the entire semicircular outer perimeter or surface 108 of peel strip segment 58A. Thus, there may be partial or continuous adhesive attachment along the entire semicircular perimeters 94 of segment 56A and 108 of segment 58A, or shorter peel strip pieces or segments may be adhesively attached to respective shorter pieces of adhesive tape which are adhesively attached to upper wall segment 52A.

Similarly, tape segment 56B may be adhesively secured to peel strip segment 58B by adhesive layer 90 via an adhesive engagement along a portion or the entire semicircular inner perimeter or surface 94 of tape segment 56B and a portion or the entire semicircular outer perimeter or surface 108 of peel strip segment 58B. Thus, there may be partial or continuous adhesive attachment along the entire semicircular perimeters 94 of segment 56B and 108 of segment 58B, or shorter peel strip pieces or segments may be adhesively attached to respective shorter pieces of adhesive tape which are adhesively attached to upper wall segment 52B.

Peel strip segment 58A may be connected to and peelably removable from adhesive layer 90 along a peelably removable connection between outer perimeter 108 of segment 58A and inner perimeter 94 of adhesive layer 90 of tape segment 56A. Likewise, peel strip segment 58B may be connected to and peelably removable from adhesive layer 90 along a peelably removable connection between outer perimeter 108 of segment 58B and inner perimeter 94 of adhesive layer 90 of tape segment 56B.

Wall 52 may have a vertical length defined between top and bottom edges 60 and 62. The vertical length of wall 52 may be, for example, within a range of about ¼ or ½ inch to about 1 or 1½ or 2 inches. Wall 54 may have a horizontal length defined between inner and outer perimeters or edges 72 and 74. The horizontal length of wall 54 may be, for example, within a range of about ¾ inch to about 1½ or 2 inches. Inner leg 76 may have a horizontal length defined between inner perimeter 64 and inner perimeter 72. The horizontal length of inner leg 76 may be, for example, within a range of about 0.04 inches to about 0.08 or 0.12 inches (or about 1 to about 2 or 3 millimeters). Outer leg 78 may have a horizontal length defined between outer perimeter 66 and outer perimeter 74. The horizontal length of outer leg 78 may be, for example, within a range of about ½ or ¾ inch to about 1¼ or 1½ or 2 inches.

Referring now to FIG. 3, inner perimeter 72 of wall 54/inner leg 76 may have an inner diameter D3 which is nearly the same as outer diameter D2 of pole 8 although very slightly larger. When ring assembly 1 is mounted on and circumscribes pole 8, inner perimeter 72 may face and be closely adjacent or in contact with outer perimeter or surface 50 of pole 8 along the entire length of inner perimeter 72, and outer perimeter 74 may face away from and be spaced from outer surface 50 by a horizontal distance essentially equal to the horizontal length of lower wall 54. Inner perimeter 94 of tape 56 also has an inner diameter D3 which may be nearly the same as or slightly larger than outer diameter D2. Inner adhesive or adhesive surface 90 is in adhesive contact with outer perimeter 50 of pole 8 when assembly 1 is mounted thereon in order to secure assembly 1 to pole 8. Adhesive layer or surface 90 may thus be in continuous contact with outer surface 50 of pole 8 all the way around pole 8 and along the entire adhesive layer or surface 90. Inner perimeter 64 of upper wall 52 may have a diameter D4 which is slightly larger than diameters D2 and D3 whereby inner perimeter 64 may be adjacent and spaced radially outwardly from outer surface or perimeter 58 a short distance all the way around outer perimeter 50 when assembly 1 is mounted on pole 8. Outer perimeter 66 of wall 52 may have an outer diameter D5 which is slightly larger than outer diameter D4 and thus larger than diameters D2 and D3 as well. Diameters D3, D4 and D5 are smaller than diameter D1 of hole 48 whereby wall 52 or a portion of ring 51/assembly 1 may be disposed within hole 48 with outer perimeter 66 of wall 52 facing away from outer surface 50 and facing and adjacent or in contact with inner perimeter or curved or semi-circular segments 40 which define hole 48. Outer perimeter 74 of lower wall 54 has an outer diameter D6 which is larger than each of diameters D1-D5. Thus, a portion of wall 54/outer wall segment 78 may extend radially outwardly beyond the inner perimeter or semi-circular segments 40 in all directions when assembly 1 is mounted on pole 8 and support pieces 6A and 6B so that the entire hole 48 is covered as viewed from below. Thus, it may be that hole 48 is not visible from below, or said another way, it may be that no portion of hole 48 is visible from below due to bottom wall 54 entirely covering hole 48 along the bottom thereof when assembly 1 is mounted on pole 8 and supporting the ceiling tile pieces 6A and 6B. It may also be that tape 56 is not visible (or no portion of tape 56 is visible) as viewed from below where inner leg 76 extends directly below and covers tape 56 as viewed from below.

Diameter D2 of pole 8 may be, for example, in a range of about 3, 3½ or 4 inches to about 6, 7 or 8 inches. The difference between diameters D6 and D3 or between diameters D6 and D2 may equal about two times the horizontal length of wall 54, whereby diameter D6 may equal diameter D2 or D3 plus about two times the horizontal length of wall 54. The difference between diameters D4 and D3 or between diameters D4 and D2 may equal about two times the horizontal length of inner wall segment 76, whereby diameter D4 may equal diameter D2 or D3 plus about two times the horizontal length of inner wall segment 76.

Figure 4:
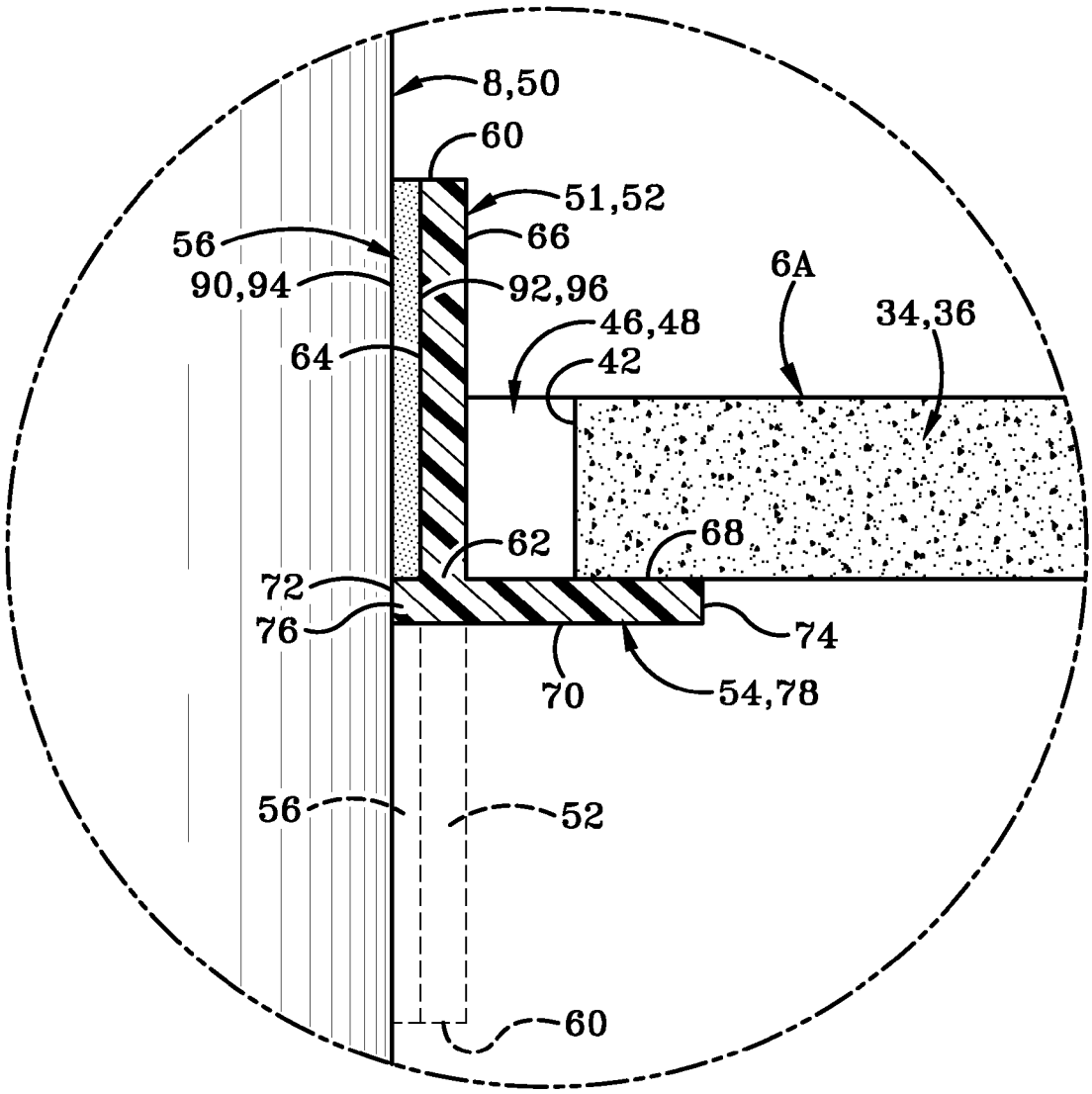
FIG. 4 is an enlarged view of the encircled portion of FIG. 3.

This paragraph continues the description of assembly 1 and the corresponding structure of drop ceiling 2 and pole 8 in the mounted position of support ring assembly 1 in which it is secured to pole 8 circumscribing outer perimeter 50 and supporting ceiling tile pieces 6A and 6B, as shown in FIGS. 1, 3 and 4. Ring assembly 1 may in its entirety be adjacent hole 48, the outer perimeter 50 of pole 8 and the inner perimeter 40 which defines hole 48. Each of legs 76 and 78 of lower wall 54 may be or extend lower than the bottom surface of each tile piece 6A and 6B. One portion of lower wall 54 is directly below spaces 46 and hole 48. A portion of outer leg 78 may be directly below hole 48/spaces 46. Another portion of outer leg 78 adjacent and including outer perimeter 74 is directly below a portion of each of tiles 6A and 6B adjacent spaces 46, hole 48 and segments or inner perimeter 40. The top surface 68 of this latter portion may serve as a drop ceiling tile seating surface or support surface. The bottom surface or another downwardly facing surface of each of tiles 6A and 6B adjacent segment 40, spaces 46 and hole 48 may be seated on the seating or support surface of top surface 68 of lower wall 54 so that wall 54 of assembly 1 supports the region of pieces 6A and 6B around hole 48. Thus, wall 54 of assembly 1 provides support to this region of tile pieces 6A and 6B so that pieces 6A and 6B (and top and bottom surfaces thereof) may be essentially horizontal when supported on assembly 1 and on the runners 10 and 12 of grid 4. More particularly, end edges 28 of pieces 6A and 6B may be seated on a left leg 20L of one of runners 12, while the opposed end edges 30 of pieces 6A and 6B may be supported on a right leg 20R of another one of runners 12. In addition, the outer side edge of pieces 6A may be supported on one of runners 10 and the outer side edge 32 of piece 6B may be supported on the adjacent runner 10. Semi-circular segments 40 may be adjacent and spaced radially outwardly from outer perimeter 50 of pole 8. The straight segments 36 of pieces 6A and 6B may be closely adjacent or in contact with one another, and the straight segments 38 of pieces 6A and 6B may likewise be closely adjacent or in contact with one another. Lower wall 54 may be entirely lower than hole 48 while upper wall 54 may extend within hole 48 and spaces 46. A portion of wall 52 may be within spaces 46 and hole 48 while another portion of wall 52 may be higher than spaces 46 and 48 and the top surface of each of pieces 6A and 6B.

While upper wall 54 has been heretofore described as extending upwardly from wall 52 within hole 48, a first alternate option may include a ring assembly which may be formed in which the upper wall 54 is eliminated and replaced by a lower wall which extends downwardly from a wall such as wall 54 and serves in a similar capacity for mounting the double-sided tape 56 below the wall 54 on which the tile pieces 6A and 6B rest. A second alternate option may include such a lower wall which may extend downward from a wall such as wall 54 while also retaining upper wall 52. Both of these options are illustrated in FIG. 4 by the addition of the downwardly extending wall which is shown in dashed lines and denoted at 52 with a lower or bottom end 60. To effect the first alternate option, ring assembly 1 may simply be turned upside down so that lower wall 54 becomes an upper wall and upper wall 52 becomes a lower wall which is secured to and extends downwardly from upper wall 54 whereby wall 52 may have a lower or bottom end 60. In this first alternate option, tape strip 56 may be below wall 54 instead of above wall 54 and may still be secured to the inner perimeter of wall 52 and the pole outer perimeter 50 below hole 48/spaces 46 instead of within and/or above hole 48/spaces 46. In the second alternate option, wall 54 may be an intermediate wall from which an upper wall 52 (solid lines) extends upwardly and a lower wall 52 (dashed lines) extends downwardly. Various other options may be understood by one skilled in the art.

On the other hand, although a generally analogous ring assembly may have somewhat different configurations than ring assembly 1, the configurations shown and described herein are simple and effective. Thus, ring assembly 1 may be formed essentially as shown without additional structures. For instance, it may be that assembly 1 or ring 51 (segments 51A, 51B) is free of a wall or structure (or includes no wall or structure) which (a) extends downward from bottom surface 70 of wall 54, (b) extends downward from bottom surface 70 of wall 54 other than wall 52 and/or tape 56 and/or peel strip 58, (c) extends upward from top surface 68 of wall 54, (d) extends upward from top surface 68 of wall 54 other than wall 52 and/or tape 56 and/or peel strip 58, (e) extends radially outward from or beyond outer perimeter 66 of wall 52 other than outer wall segment 78, and/or (f) extends radially inward from or beyond inner perimeter 64 of wall 52 other than inner wall segment 76 and/or tape 56 and/or adhesive layers 90, 92 and/or peel strip 58.

To install the support ring assembly 1 with a one-piece ring on pole 8, the user may simply manually grab one of ends 110 or 112 of peel strip 58 and pull it away from inner adhesive layer 90 of tape 56 to peel strip 58 off of adhesive 90 (arrow C in FIG. 2A) to completely remove strip 58 from adhesive 90. This removal of strip 58 thus exposes adhesive 90 to allow it to be secured to pole 8. After the strip 58 is removed, the user may move the ring assembly 1 from its home position (solid lines in FIG. 2A) to a displaced position by moving the circumferential ends of the ring assembly away from each other, illustrated at arrows A and B in FIG. 2A, to form the gap or side entrance opening 86 of passage 53. Once gap 86 is larger or wider than outer diameter D2 of pole 8, the user moves assembly 1 toward and around the outer surface 50 of pole 8, as shown at arrow D in FIG. 3. The user may then move assembly 1 upwardly as shown in arrow E in FIG. 3, or otherwise move assembly 1 up or down so that assembly 1 reaches the desired height at which the user desires to secure ring assembly 1 to pole 8, at which time the user presses radially inwardly (arrows F in FIG. 3) on ring 51 to move adhesive layer 90/surface 94 into contact with outer perimeter 50 of pole 8 to adhesively secure ring assembly 1 to pole 8 in the mounting or mounted position via an adhesive engagement or connection between layer 90/surface 94 and outer surface 50. Securing the ring assembly to the pole may thus form a ceiling tile support or support assembly which supports the drop ceiling tile, wherein the ceiling tile support or support assembly may include pole 8 and ring assembly 1. Ceiling tile pieces 6A and 6B may be positioned within space 14 and seated on runners 10, 12 and wall 54 of assembly 1 as previously described in order to support tile pieces 6A and 6B in an essentially horizontal position.

To install the two-piece support ring assembly 1 on pole 8, the user may begin by simply manually grab one of ends 110 or 110A of peel strip segment 58A and pull it away from inner adhesive layer 90 of tape segment 56A to peel strip segment 58A off of adhesive 90 to completely remove strip segment 58A from adhesive 90. This removal of strip segment 58A thus exposes adhesive 90 of tape segment 56A to allow it to be secured to pole 8. After the strip segment 58A is removed, the user may move the first ring subassembly of assembly 1 (comprising ring segment 51A and tape segment 56A adhesively secured thereto) toward pole 8 and upwardly (such as shown generally at arrows D and E in FIG. 3), or otherwise move the first ring subassembly up or down so that the first ring subassembly reaches the desired height at which the user desires to secure the first ring subassembly to pole 8, at which time the user presses radially inwardly (arrows F in FIG. 3) on ring segment 51A to move adhesive layer 90/surface 94 of tape segment 56A into contact with outer perimeter 50 of pole 8 to adhesively secure the first ring subassembly to pole 8 via an adhesive engagement or connection between layer 90/surface 94 of tape segment 56A and outer surface 50.

Prior to the user pressing the adhesive of tape segment 56A onto outer surface 50, the user may manually grasp or grip ring segment 51A adjacent ends 84 and 84A thereof to move ends 84 and 84A away from one another and tape segment ends 98 and 98A away from one another (Arrows G in FIG. 2B) by flexing of ring segment 51A and tape segment 56A, which may facilitate positioning ring segment 51A and tape segment 56A around pole outer surface 50 at the desired height immediately prior to adhering the tape segment 56A/ring segment 51A to pole outer surface 50 at the desired mounting location or position. Ring segment 51A and tape segment 56A may then be flexibly moved so that the ring segment ends and tape segment ends move toward one another and toward outer surface 50 until the adhesive is pressed against surface 50. This flexing of segment 51A and 56A to move their ends toward one another may be assisted by the resilient nature of segment 51A, which may return said ends to their home positions.

After ring segment 51A is mounted on pole 8, the user may then simply manually grab one of ends 112 or 112A of peel strip segment 58B and pull it away from inner adhesive layer 90 of tape segment 56B to peel strip segment 58B off of adhesive 90 to completely remove strip segment 58B from adhesive 90. This removal of strip segment 58B thus exposes adhesive 90 of tape segment 56B to allow it to be secured to pole 8. After the strip segment 58B is removed, the user may move the second ring subassembly of assembly 1 (comprising ring segment 51B and tape segment 56B adhesively secured thereto) toward pole 8 and upwardly (such as shown generally at arrows D and E in FIG. 3), or otherwise move the second ring subassembly up or down so that the second ring subassembly reaches the desired height at which the user desires to secure the second ring subassembly to pole 8 (i.e., the same height at which the first ring subassembly is secured to pole 8), at which time the user presses radially inwardly (arrows F in FIG. 3) on ring segment 51B to move adhesive layer 90/surface 94 of tape segment 56B into contact with outer perimeter 50 of pole 8 to adhesively secure the second ring subassembly to pole 8 via an adhesive engagement or connection between layer 90/surface 94 of tape segment 56B and outer surface 50.

Prior to the user pressing the adhesive of tape segment 56B onto outer surface 50, the user may manually grasp or grip ring segment 51B adjacent ends 82 and 82A to flex ring segment and move ends 82 and 82A in the same manner as described previously with respect to ring segment 51A and ends 84 and 84A thereof. As the user is positioning ring segment 51B to mount or adhesively secure ring segment 51B on pole outer surface 50, the user may position ends 82 and 82A respectively facing and closely adjacent or in contact with ends 84 and 84A of ring segment 51A to provide the mounted position of ring segments 51A and 51B previously described.

At this point, the two-piece ring assembly 1 is mounted on pole 8 in the mounting or mounted position. Securing ring assembly 1 to pole 8 thus forms a ceiling tile support which may include pole 8 and assembly 1 and which may support ceiling tile 6. More particularly, ceiling tile pieces 6A and 6B may be positioned within space 14 and seated on runners 10, 12 and wall 54/wall segments 54A and 54B in order to support tile pieces 6A and 6B in an essentially horizontal position.

It is noted that the horizontal length of inner wall segment or leg 76 may be essentially the same as the horizontal width of tape 56/segments 56A, 56B in the mounted position and nearly the same as or slightly less than the horizontal width of tape 56 in the home or unmounted position. Thus, tape 56 may extend radially inward a short distance beyond inner edge 72 of leg 76 in the home or unmounted position of assembly 1 so that the inner adhesive surface may easily contact pole outer surface 50 during mounting of assembly 1 thereon. As tape 56 is pressed against outer surface 50 during the mounting of assembly 1, tape 56 may be compressed horizontally slightly.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example and not limited to the exact details shown or described.

The invention claimed is:

1. A combination comprising:

a drop ceiling tile having top and bottom surfaces and defining a hole extending from the top surface to the bottom surface;

a pole extending through the hole; and a ring assembly which is adjacent the hole, which is secured to and circumscribes the pole, and which supports the ceiling tile;

wherein the pole has a pole outer surface;

the ring assembly comprises a ring having a ring inner perimeter which faces the pole outer surface;

an adhesive extends along the ring inner perimeter and adhesively secures the ring assembly to the pole;

the ring has an annular lower wall and an annular upper wall which is secured to and extends upwardly from the annular lower wall and which has an upper wall inner perimeter which serves as the ring inner perimeter; and the lower wall comprises an inner segment which extends radially inward beyond the upper wall inner perimeter to a lower wall inner perimeter which is adjacent or in contact with the pole outer surface.

2. The combination of claim 1 wherein the annular lower wall and annular upper wall are perpendicular to one another as viewed in cross section.

3. The combination of claim 2 wherein the annular lower wall is horizontal as viewed in cross section and the annular upper wall is vertical as viewed in cross section.

4. The combination of claim 1 wherein a first portion of the ring assembly extends within the hole.

5. The combination of claim 4 wherein a second portion of the ring assembly extends below the hole and ceiling tile.

6. The combination of claim 1 wherein the ring circumscribes the pole;

the ceiling tile is seated on the annular lower wall; and the annular upper wall extends within the hole.

7. The combination of claim 1 wherein the ring circumscribes the pole;

the ceiling tile is seated on the annular lower wall; and the ring includes an additional annular wall which is secured to and extends downward from the annular lower wall.

8. The combination of claim 1 further comprising a strip of double-sided tape which comprises the adhesive; wherein the adhesive comprises outer and inner adhesive surfaces respectively in contact with the upper wall inner perimeter and the pole outer surface.

9. The combination of claim 8 wherein the upper wall has an upper wall outer perimeter which faces away from the pole outer surface;

the lower wall comprises an outer segment which extends radially outwardly beyond the upper wall outer perimeter to a lower wall outer perimeter; and the ceiling tile is seated on the outer segment.

10. The combination of claim 1 wherein the ring circumscribes the pole;

the annular upper wall has an annular upper wall outer perimeter which faces away from the pole outer surface;

the annular lower wall comprises an outer wall segment which extends radially outwardly beyond the annular upper wall outer perimeter; and the ceiling tile is seated on the outer wall segment.

11. The combination of claim 1 further comprising a strip of double-sided tape which comprises the adhesive.

12. The combination of claim 1 wherein the ring comprises first and second ring segments.

13. The combination of claim 12 wherein the first ring segment has first and second circumferential ends; and the first ring segment is formed of a resilient material so that the first and second circumferential ends are movable toward and away from one another by flexing movement of the first ring segment.

14. The combination of claim 12 wherein the first ring segment has first and second circumferential ends; and the second ring segment has first and second circumferential ends which are respectively adjacent or in contact with the first and second circumferential ends of the first ring segment.

15. The combination of claim 1 wherein the ring is a one-piece ring which is formed of a resilient material, defines a pole-receiving through passage, and has first and second circumferential ends;

the ring has a home position and a displaced position;

the first and second circumferential ends are adjacent and face one another in the home position; and the first and second circumferential ends are distal one another in the displaced position and define therebetween a side entrance opening through which the pole is receivable into the pole-receiving passage during mounting of the ring assembly on the pole.

16. A method comprising the steps of:

providing a drop ceiling tile having top and bottom surfaces and defining a hole extending from the top surface to the bottom surface;

providing a ring assembly comprising a ring having an annular lower wall and an annular upper wall which is secured to and extends upwardly from the annular lower wall and which has an upper wall inner perimeter which serves as a ring inner perimeter, and wherein the lower wall comprises an inner segment which extends radially inward beyond the upper wall inner perimeter to a lower wall inner perimeter; and with an adhesive which extends along the ring inner perimeter, adhesively securing the ring assembly to an outer surface of a pole which extends through the hole to form a ceiling tile support which supports the drop ceiling tile so that the ring inner perimeter faces the pole outer surface and so that the lower wall inner perimeter is adjacent or in contact with the outer surface of the pole.

* * * * *